US010216216B2

(12) United States Patent
Sugiyama

(10) Patent No.: US 10,216,216 B2
(45) Date of Patent: Feb. 26, 2019

(54) LEVER UNIT

(71) Applicant: OMRON Corporation, Kyoto-shi, Kyoto (JP)

(72) Inventor: Hiroaki Sugiyama, Hashima-gun (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/553,000

(22) PCT Filed: Mar. 20, 2015

(86) PCT No.: PCT/JP2015/058605
§ 371 (c)(1),
(2) Date: Aug. 23, 2017

(87) PCT Pub. No.: WO2016/151709
PCT Pub. Date: Sep. 29, 2016

(65) Prior Publication Data

US 2018/0032098 A1 Feb. 1, 2018

(51) Int. Cl.
*G05G 5/06* (2006.01)
*G05G 1/04* (2006.01)
(Continued)

(52) U.S. Cl.
CPC ..... *G05G 5/06* (2013.01); *G05G 1/04* (2013.01); *G07F 17/32* (2013.01);
(Continued)

(58) Field of Classification Search
CPC .. G05G 5/06; G05G 1/04; G05G 5/18; G05G 5/24; G07F 17/3209
(Continued)

(56) References Cited

U.S. PATENT DOCUMENTS 1,454,398 A * 5/1923 Mackenzie ..... B66D 1/06 74/159
2,669,883 A * 2/1954 Duncan ..... B60T 7/101 74/503
3,581,586 A * 6/1971 Blackburn ..... B66D 1/06 254/369

FOREIGN PATENT DOCUMENTS

JP H11-348740 A 12/1999
JP 2002-307318 A 10/2002
JP 2014-212813 A 11/2014

OTHER PUBLICATIONS

English translation of Written Opinion of PCT/JP2015/058605 dated Apr. 21, 2015.

(Continued)

*Primary Examiner* — David H Bollinger
(74) *Attorney, Agent, or Firm* — Metrolexis Law Group, PLLC

(57) ABSTRACT

A lever unit is provided with a start lever rotatably provided on a securing shaft, a ratchet mechanism that restricts a movement direction of the start lever to one direction, and a reset mechanism that releases the restriction on the movement direction by the ratchet mechanism, wherein the ratchet mechanism is provided with a rotation plate that rotates integrally with the start lever and on which multiple teeth are formed on an outer edge thereof, and multiple latch pieces having engaging portions that mesh with tooth depression portions between the teeth of the rotation plate, wherein the multiple latch pieces are set in an array along an outer edge of the rotation plate so that each time the rotation plate moves a single pitch portion of the teeth, the engaging portions of all of the latch pieces mesh alternately with one of the tooth depression portions.

6 Claims, 13 Drawing Sheets

(51) Int. Cl.
*G07F 17/32* (2006.01)
*G07F 17/34* (2006.01)

(52) U.S. Cl.
CPC ..... *G07F 17/3209* (2013.01); *G07F 17/3213* (2013.01); *G07F 17/34* (2013.01)

(58) Field of Classification Search
USPC ..... 74/504, 519, 523, 528, 533, 534, 540, 74/541
See application file for complete search history.

(56) References Cited

OTHER PUBLICATIONS

The International Search Report of PCT/JP2015/058605 dated Apr. 21, 2015.

* cited by examiner

LEVER UNIT

TECHNICAL FIELD

The present invention relates to lever units provided in gaming machines such as slot machines.

RELATED ART

In slot machines, which are one type of gaming machine, multiple reels rotate on which are displayed multiple types of symbols. And when the reels stop, points are determined according to the manner in which the symbols displayed in a window are arrayed or according to the arrayed symbols themselves. A prize is allotted to the player in accordance with the points that have been determined and the size of the bet (the amount wagered). The reels commence to rotate due to operation of a rotation start button or a rotation start lever provided on the slot machine. In slot machines installed in casinos or the like, the reels are stopped automatically under the control of the device.

In this regard, in gaming facilities such as casinos, the slot machines are not manufactured by a single manufacturer of gaming machines, but rather slot machines are installed from various gaming machine manufacturers. The player selects a machine of his or her preference from among these machines to play a game. For this reason, the gaming facility installs slot machines that are popular with players, thereby aiming to maintain a superiority over other competing gaming facilities. Furthermore, gaming machine manufacturers continue to conduct development so as to be able to provide slot machines that can be appealing to players.

It is in these circumstances that the applicants of the present application invented a lever unit capable of being used as a lever for commencing rotation of the reels and applied for this prior to the present application (Patent Document 1). As shown in FIG. 13, this lever unit is provided with a start lever 100 and a ratchet mechanism 101. The operating direction of the start lever 100 is restricted by the ratchet mechanism 101 to one direction from a home position HP to an end position EP.

The ratchet mechanism 101 is provided with a rotation plate 102 and a ratchet pawl 103. The rotation plate 102 rotates integrally with the start lever 100, and multiple teeth 104 are formed on its outer edge in a sawtooth shape. On the other hand, the ratchet pawl 103 is arranged so as to readily rotate on the outer periphery of the rotation plate 102, and is biased so as to engage with a tooth depression portion 105 between each of the teeth 104.

When the start lever 100 is pulled down, the rotation plate 102 rotates and the ratchet pawl 103 shifts incrementally from one engaged tooth depression portion 105 to the next. In this way, an operator of the start lever 100 is able to obtain a gratifying clicking sensation. On the other hand, in a state where the ratchet pawl 103 has engaged with a tooth depression portion 105, the tooth 104 hits against the ratchet pawl 103 even if an attempt is made to move the start lever 100 in a direction pulling it up, and the rotation plate 102 cannot be caused to rotate.

When the start lever 100 reaches the end position, the engagement between the ratchet pawl 103 and the tooth depression portion 105 is released. In this way, the start lever 100 can return to the home position.

RELATED ART DOCUMENTS

Patent Documents

Patent Document 1: JP 2014-212813A (published 17 Nov. 2014)

SUMMARY OF THE INVENTION

Problem to be Solved by the Invention

However, the configuration of Patent Document 1 has an area for improvement in that it is difficult to achieve a gratifying sensation (of the lever being pulled) and to maintain the strength of the ratchet mechanism. This reason is discussed hereafter.

With the configuration of Patent Document 1, compared to the length from the rotational center of the start lever 100, the distance from the rotational center of the teeth 104 is short. Thus, the rotation distance of the rotation plate 102 for a single step (the movement distance of the outer peripheral portion formed by the teeth 104) is small, and the teeth 104 are set having a short pitch. It should be noted that a single step corresponds to a single notch obtainable when operating the start lever 100.

With the configuration in Patent Document 1, the form of engagement in the ratchet mechanism is constructed to be small so as to achieve a short pitch. However, the clicking sensation becomes unfortunately smaller when the form of engagement is small, and the strength of the engaging portions is also unfortunately reduced. Thus, it becomes harder to achieve a gratifying sensation, and it also becomes harder to maintain the strength of the ratchet mechanism.

The present invention is devised in consideration of the above issues and it is an object thereof to provide a lever unit that is capable of simultaneously achieving a gratifying sensation and maintaining the strength of the ratchet mechanism even with a small rotation distance of the rotation plate per single step.

Means for Solving the Problems

In order to address the aforementioned issues, a lever unit according to the present invention is provided with a lever rotatably provided on a shaft, a ratchet mechanism that restricts a movement direction of the lever to one direction, and a reset mechanism that releases the restriction on the movement direction by the ratchet mechanism, wherein the ratchet mechanism is provided with a rotational body that rotates integrally with the lever and on which multiple teeth are formed on an outer edge thereof, and multiple latch pieces having engaging portions that mesh with tooth depression portions between the teeth of the rotational body, and the multiple latch pieces are set in an array along an outer edge of the rotational body so that each time the rotational body moves a single pitch portion of the teeth, the engaging portions of all of the latch pieces mesh alternately with one of the tooth depression portions.

Effects of the Invention

According to the present invention, an effect is achieved of being able to provide a lever unit that is capable of simultaneously achieving a gratifying sensation and maintaining the strength of the ratchet mechanism even with a small rotation distance of the rotation plate per single step.

EMBODIMENTS OF THE INVENTION

Hereinafter, embodiments of the present invention are described in detail. In the present embodiment, a lever unit is used as an illustrative example equipped in a slot machine as a gaming machine installed in a gaming facility such as a casino.

Configuration of Slot Machine

Figure 1:
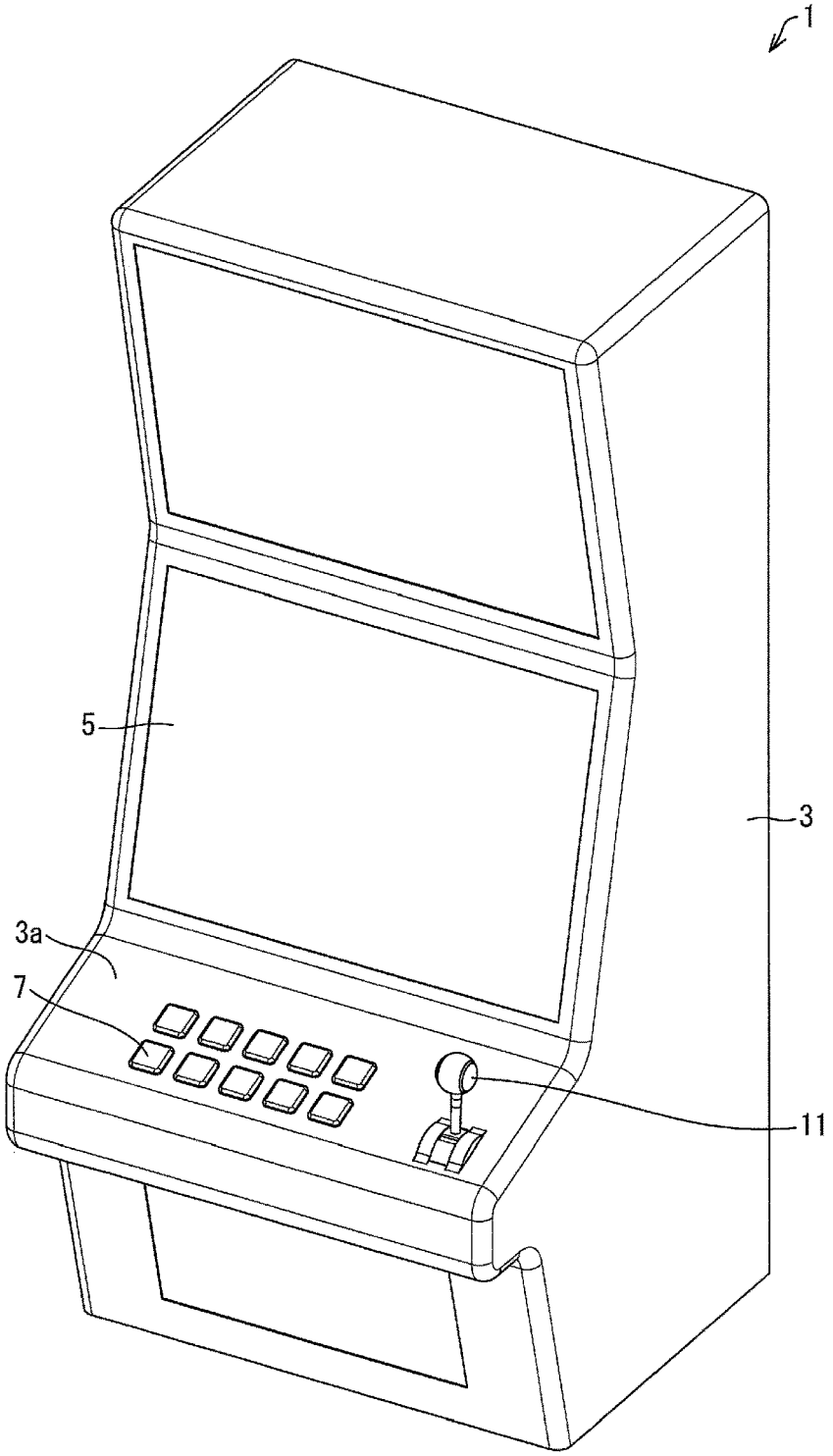
FIG. 1 is an external perspective view of a slot machine provided with a lever unit pertaining to the present embodiment.

FIG. 1 is an external perspective view of a slot machine 1 in which is installed a lever unit 10 pertaining to the present embodiment. As shown in FIG. 1, the slot machine 1 is equipped with a reel portion 5 in a center portion of a front surface facing the player (operator).

Multiple reels (not shown in drawings) are provided in the reel portion 5 in which are displayed multiple types of symbols. Rotation of the multiple reels commences by the player operating the start lever (lever) 11, and this stops automatically under the control of the machine. Points are determined according to the manner in which the symbols displayed in a window (not shown in drawings) of the reel portion 5 are arrayed when the reels are stopped or according to the arrayed symbols themselves. A prize is allotted to the player in accordance with the points that have been determined and the size of the bet (the amount wagered). It should be noted in regard to the configuration of the reel portion 5 that, in addition to a configuration in which actual reels are installed, a configuration may be employed in which the reel portion 5 is configured using a display screen such as a liquid crystal display, and images corresponding to the reels are displayed.

Installed below the reel portion 5 are a switch portion 7, which includes multiple push-type switches, and a start lever 11. The switch portion 7 and the start lever 11 receive operations from the player. The switch portion 7 receives instructions of bet amounts when the slot machine 1 is played by the player. The start lever 11 receives an instruction to commence rotation of the reels in the reel portion 5. The switch portion 7 and the start lever 11 are both installed in a protruding portion 3*a* that is provided protruding out from a housing 3 of the slot machine 1 toward the player.

It should be noted that in FIG. 1 an example configuration is illustrated in which the start lever 11 is positioned on a front right side of the slot machine 1, but a configuration may be used in which this is positioned on the left side. The configuration of the start lever 11 is a feature of the slot machine 1 according to the present embodiment and description thereof is given hereafter.

Configuration of Lever Unit

Figure 2:
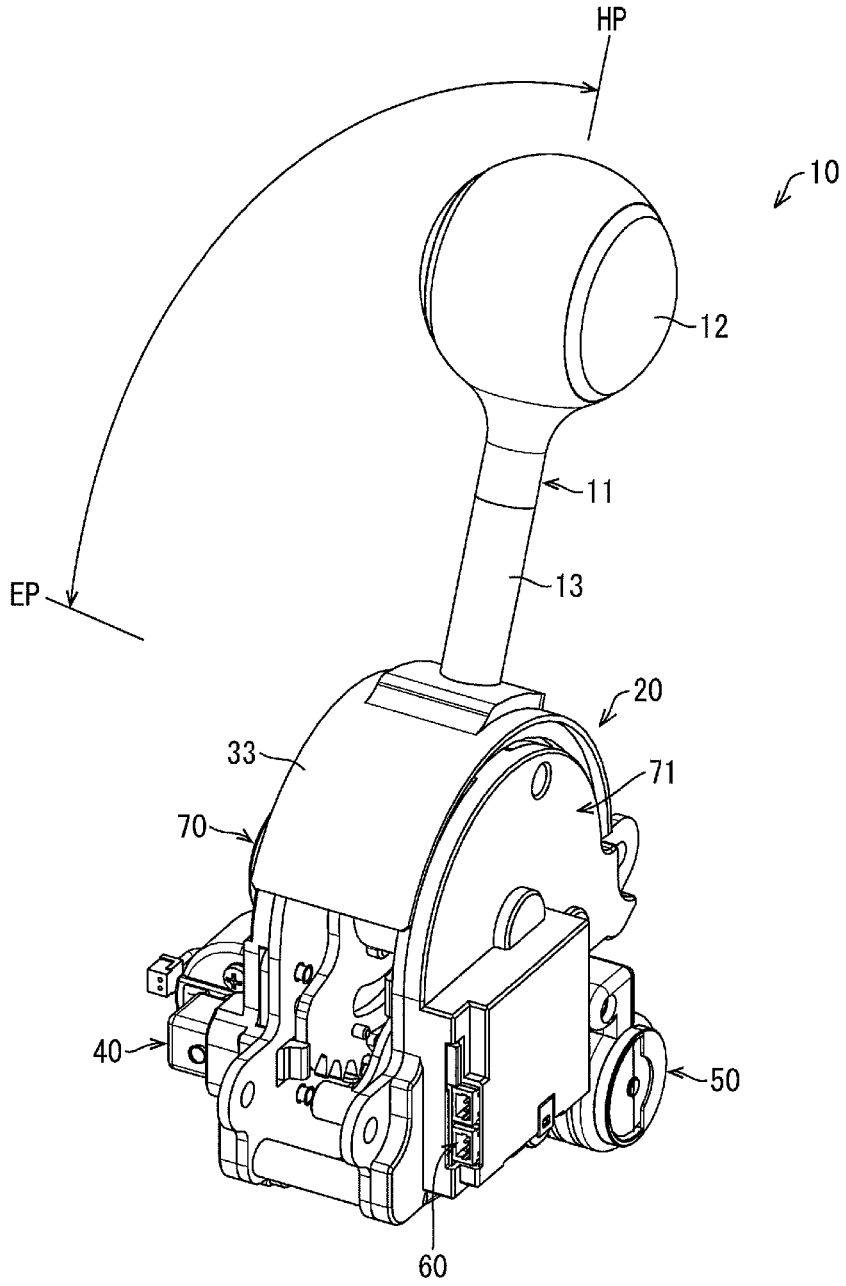
FIG. 2 is an external perspective view of the lever unit.

The start lever 11 is one structural component of the lever unit 10. The lever unit 10 is installed on the above-mentioned protruding portion 3*a* on the housing 3 of the slot machine 1. FIG. 2 shows an external perspective view of the lever unit 10 according to the present embodiment, and FIG. 3 shows an exploded perspective view of this lever unit 10.

Figure 3:
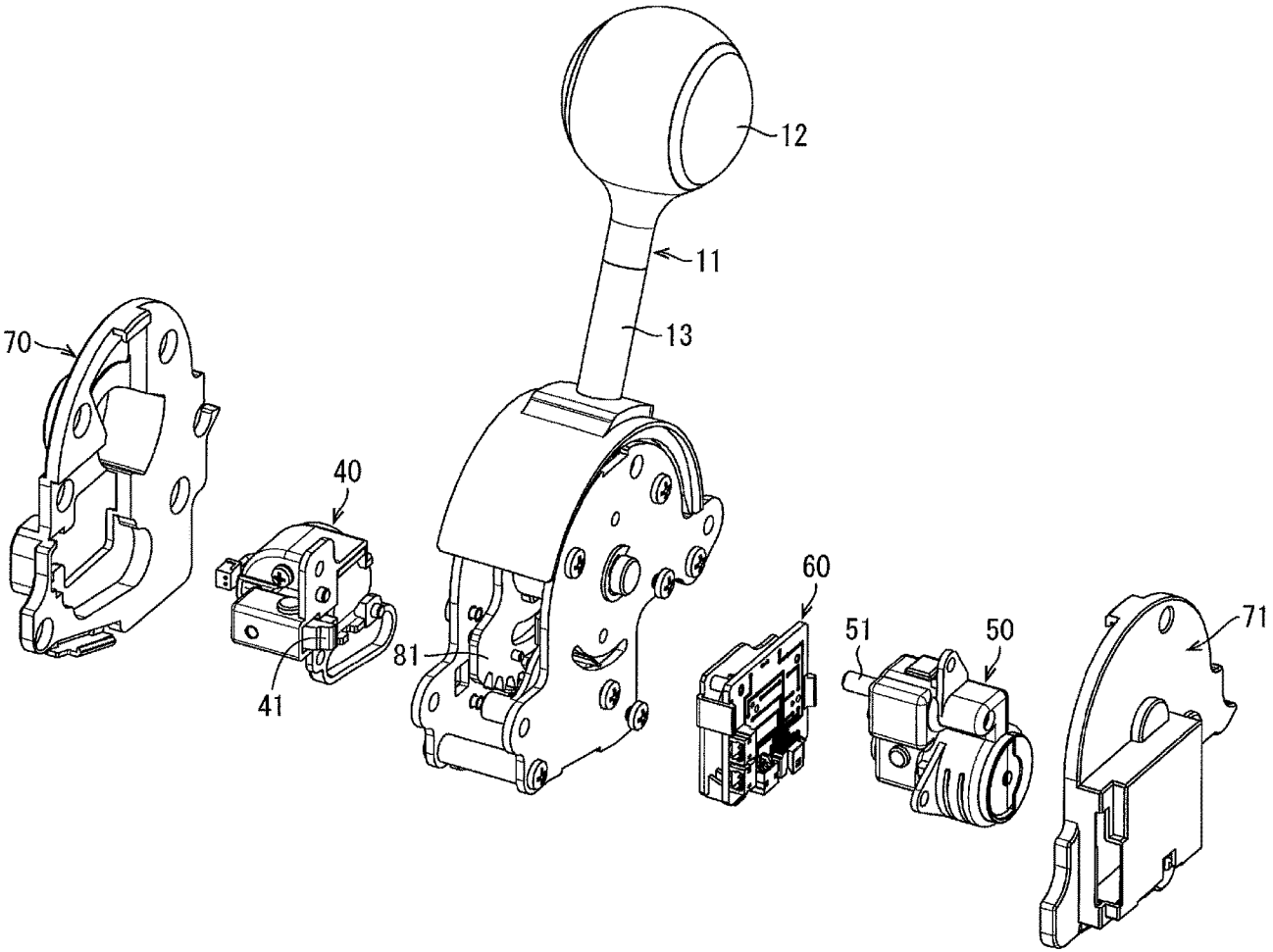
FIG. 3 is an exploded perspective view of the lever unit.

As shown in FIG. 2 and FIG. 3, a knock module 40, a lock module 50, and an encoder board module 60 are installed in a handle module 20 provided with the start lever 11, and the lever unit 10 has both of its sides covered by side covers 70 and 71.

The handle module 20 supports the start lever 11 so that it can readily move in both directions between the home position HP and the end position EP (see FIG. 2) and detailed description thereof is given later.

The knock module 40 is provided with a knocker 41 that is caused to oscillate by a solenoid (not shown in drawings). With the knocker 41, the knock module 40 knocks a rotation plate 81, which is integrated into the start lever 11 and is described later, and gives vibration and impact to the start lever 11.

The lock module 50 is provided with a lock member 51 that engages with the rotation plate 81 to lock the start lever 11. Other than times when it is related to the game being used in the slot machine 1, the lock module 50 locks the start lever 11 and disables its operation.

The encoder board module 60 is provided with multiple photomicrosensors (not shown in drawings). Using the multiple photomicrosensors, the encoder board module 60 detects the position of the start lever 11.

Configuration of Handle Module

Figure 4:
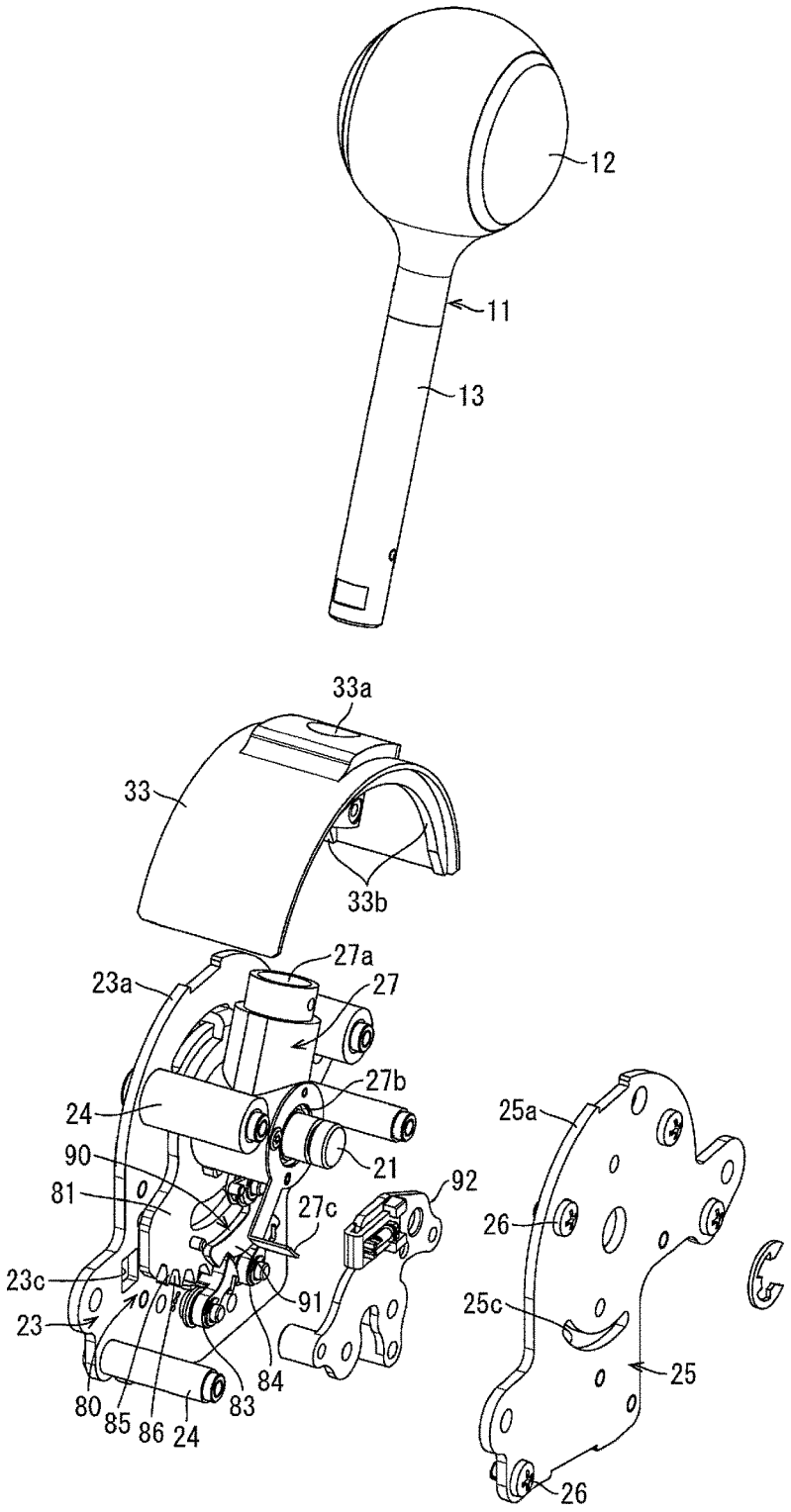
FIG. 4 is an exploded perspective view of a handle module in the lever unit.

FIG. 4 shows an exploded perspective view of the handle module 20 in the lever unit 10. As shown in FIG. 4, the handle module 20 is provided with the start lever 11, a support member 27, a ratchet mechanism 80, and a reset mechanism 90.

The start lever 11 has a spherical grip portion 12 at the leading edge portion of a shaft 13. A base end side of the shaft 13 is coupled to a coupling portion 27*a* of the support member 27 via an aperture 33*a* provided in an outer covering 33 and is secured with a screw. In this way, the start lever 11 is secured to the support member 27 along with the outer covering 33, and is integrated into the support member 27.

The support member 27 supports the start lever 11 so that it readily rotates on a pair of frames 23 and 25. The support member 27 is provided with a shaft hole 27*b* that penetrates in a direction forming a right angle with a shaft direction of the shaft 13 of the start lever 11. A securing shaft 21 that is secured in the pair of frames 23 and 25 is inserted through the shaft hole 27*b*. Due to this, the support member 27 rotates readily on the securing shaft 21 and thus the start lever 11, which is secured to the support member 27, and the outer covering 33 both rotate readily on the securing shaft 21 via the support member 27. And the support member 27 constantly applies a biasing force to the start lever 11 using an unshown biasing spring in a direction returning to the home position HP.

It should be noted that in the present embodiment an example configuration is illustrated in which the securing shaft 21 is secured to the pair of frames 23 and 25, and the support member 27 rotates on the securing shaft 21. However, configurations are also possible in which the securing shaft 21 is secured to the support member 27, and the securing shaft 21 rotates readily on the pair of frames 23 and 25.

The pair of frames 23 and 25 are secured with screws 26 through multiple securing portions 24, and are supported at predetermined intervals. These frames 23 and 25 have similar outer edge shapes. The upper outer edges of the frames 23 and 25 are provided with sliding regions 23*a* and 25*a* for the outer covering 33, which delineate a circular arc centered on the securing shaft 21. Guiding portions 33*b* and 33*b* are provided on the inner side of the outer covering 33 for the above-mentioned sliding regions 23*a* and 25*a* to slide on.

Furthermore, of the frames 23 and 25, it is on the frame 23 on which the knock module 40 is attached on an outer side that an opening 23*c* is formed so that a knocker 41 of the knock module 40 juts out into an inner side of the frame 23.

Furthermore, on the frame 25 on which the encoder board module 60 is installed on an outer side, an opening 25*c* is formed so that a detection piece 27*c* used by the encoder board module 60 in detecting the position of the start lever 11 juts out to an outer side of the frame 25. The detection piece 27*c* is attached to the support member 27 and moves integrally with the start lever 11.

The ratchet mechanism 80 is a component for restricting the operating direction of the start lever 11 to one direction. The ratchet mechanism 80 is provided with the rotation plate 81 as a rotation member and two ratchet pawls 83 and 84 as multiple latch pieces.

The reset mechanism 90 is a component for releasing the restriction on the operating direction of the start lever 11 by the ratchet mechanism 80. The reset mechanism 90 is provided with a reset piece 91 as a releasing piece, a ratchet mechanism cover 92, a reset piece biasing disk 93 that is described later, and a reset piece biasing disk guide 94.

Configuration of Ratchet Mechanism 80

Figure 5:
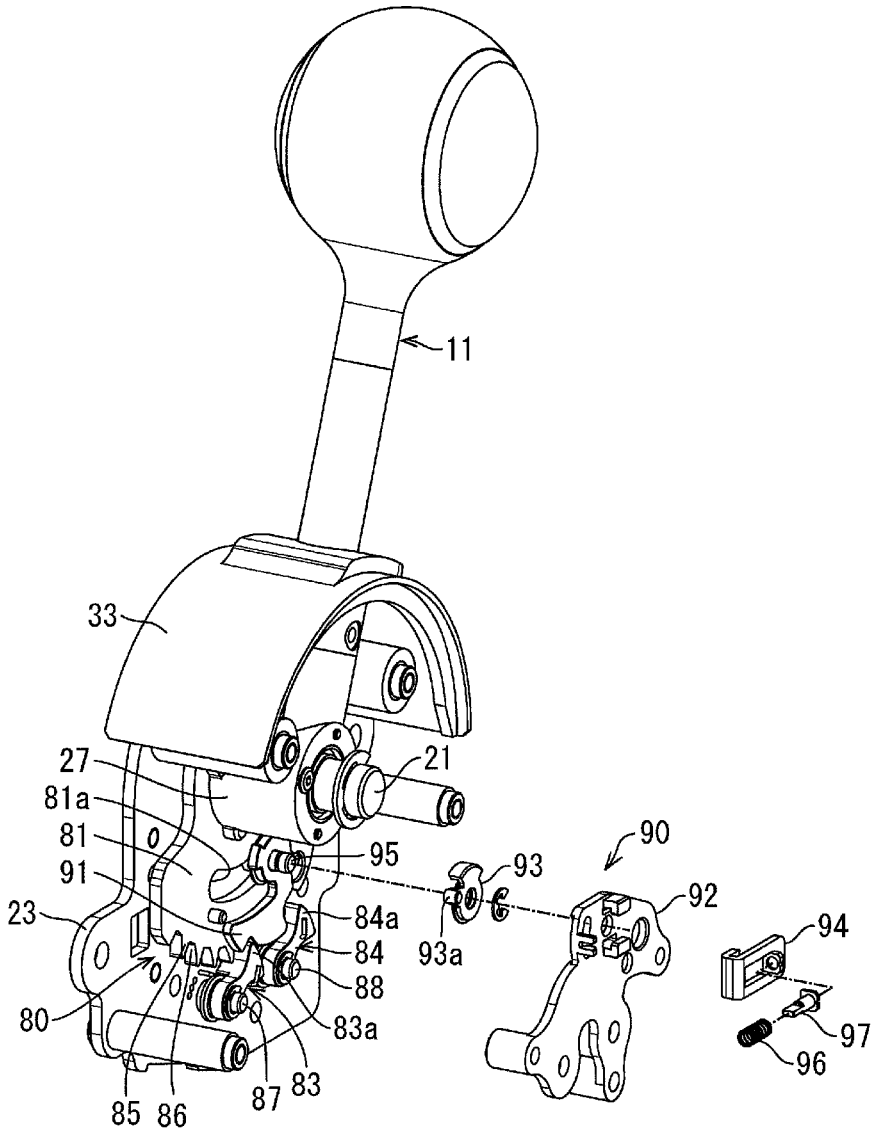
FIG. 5 is an exploded perspective view of principal components of the handle module for describing configurations of the ratchet mechanism and the reset mechanism installed in the handle module.
Figure 6:
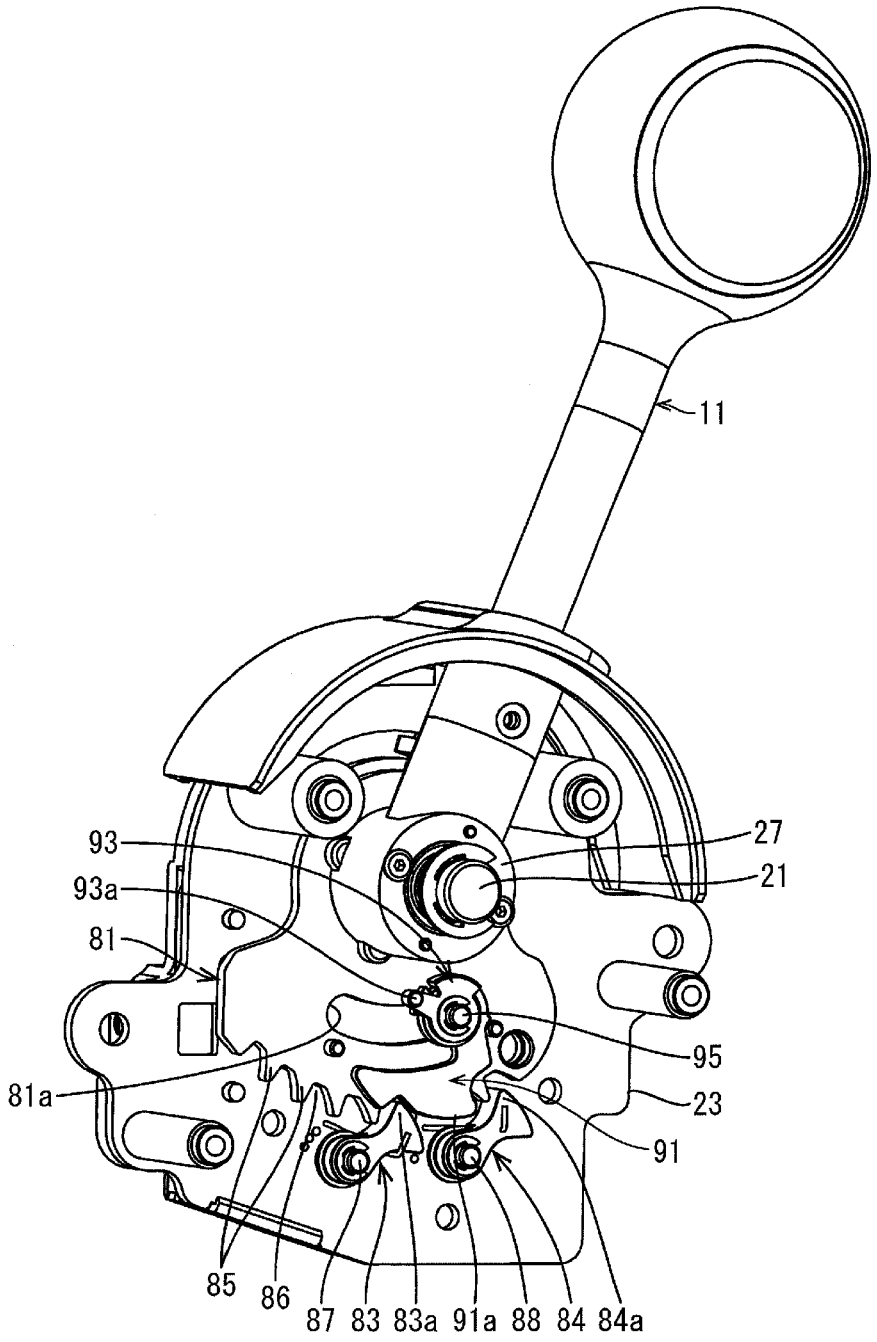
FIG. 6 is a perspective view of principal components of the handle module 20 for describing configurations of the ratchet mechanism and the reset mechanism.

Description is given using FIG. 5 and FIG. 6 regarding a configuration of the ratchet mechanism 80. FIG. 5 is an exploded perspective view of principal components of the handle module 20 for describing configurations of the ratchet mechanism 80 and the reset mechanism 90 installed in the handle module 20. FIG. 6 is a perspective view of principal components of the handle module 20 for describing configurations of the ratchet mechanism 80 and the reset mechanism 90.

As shown in FIG. 5 and FIG. 6, the ratchet mechanism 80 is provided with the rotation plate 81 and two ratchet pawls 83 and 84. The rotation plate 81 is attached to the support member 27 in a state in which it lies along an inner side surface of the frame 23. In this way, the rotation plate 81 moves integrally with the start lever 11 centered on the securing shaft 21. Multiple teeth 85 are formed in a sawtooth shape at the outer edge of the rotation plate 81.

The pitch of the teeth 85 is determined based on the required strength and sensation as well as the space that can be assigned to the ratchet mechanism 80. In a case where the space that can be assigned to the ratchet mechanism 80 is small due to space constraints on the side of the slot machine 1 in which the lever unit 10 is to be installed, the rotation plate 81 becomes smaller and the length from the securing shaft 21 to the outer edge at which the teeth 85 are formed becomes smaller than the length of the start lever 11 from the securing shaft 21. In the lever unit 10 of the present embodiment, the length from the securing shaft 21 to the outer edge at which the teeth 85 are formed in the rotation plate 81 is set to ⅓ or less (for example, 1/3.8) of the length of the start lever 11 from the securing shaft 21.

The ratchet pawls 83 and 84 are set in an array on the outer perimeter of the area where the multiple teeth 85 are formed on the rotation plate 81, lined up along the movement direction thereof. The ratchet pawls 83 and 84 are rotatably supported on shafts 87 and 88, which are installed protruding to the inner side of the frame 23, and are constantly under a biasing force. The direction of the biasing force is a direction opposite to the direction in which the multiple teeth 85 formed on the rotation plate 81 move accompanying the start lever 11 being pulled down. Furthermore, engaging portions 83*a* and 84*a* that mesh with tooth depression portions 86 (between the teeth 85) of the rotation plate 81 are installed on the ratchet pawls 83 and 84.

And the ratchet pawls 83 and 84 are set in an array along the outer edge of the rotation plate 81 so that each time the rotation plate 81 moves a single pitch portion of the teeth 85, the engaging portions 83*a* and 84*a* of the ratchet pawls 83 and 84 mesh alternately with one of the tooth depression portions 86. In this way, while the rotation plate 81 moves a single pitch portion of the teeth 85, the 83*a* and 84*a* of the two ratchet pawls 83 and 84 mesh with one of the tooth depression portions 86 with shifted timings.

Specifically, the interval between the engaging portions 83*a* and 84*a* of the two ratchet pawls 83 and 84 is set to (N+0.5) times the pitch of the teeth 85. N is zero and natural numbers. In this way, the two ratchet pawls 83 and 84 do not mesh with the tooth depression portions 86 at the same time, but rather mesh alternately each time the rotation plate 81 rotates by a distance that is ½ of the pitch of the teeth. In the configurations shown in FIG. 5 and FIG. 6, the interval between the engaging portions 83*a* and 84*a* is set to 2.5 times a pitch P.

When the rotation plate 81 rotates, the ratchet pawls 83 and 84 that are meshed with the teeth 85 have the meshing released by being pushed down resisting the biasing force of the teeth 85 adjacent to the tooth depression portions 86 with which they had been meshed, then mesh with the next tooth depression portion 86. By repeating the meshing and releasing in this manner, the tooth depression portions 86 to be enmeshed with are successively switched and rotation in the direction of the start lever 11 being pulled down is made possible. And at this time the operator of the start lever 11 is able to obtain a gratifying clicking sensation.

Furthermore, a force is constantly being applied to the start lever 11 in the direction returning to the home position HP due to a biasing spring installed on the support member 27. However, one of the ratchet pawls 83 and 84 is always meshed with a tooth depression portion 86, and the tooth 85 adjacent to the tooth depression portion 86 that is enmeshed and the ratchet pawl 83 or 84 that is enmeshed are in contact with each other, and therefore the rotation plate 81 does not rotate.

Operation of Ratchet Mechanism 80

Figure 7:
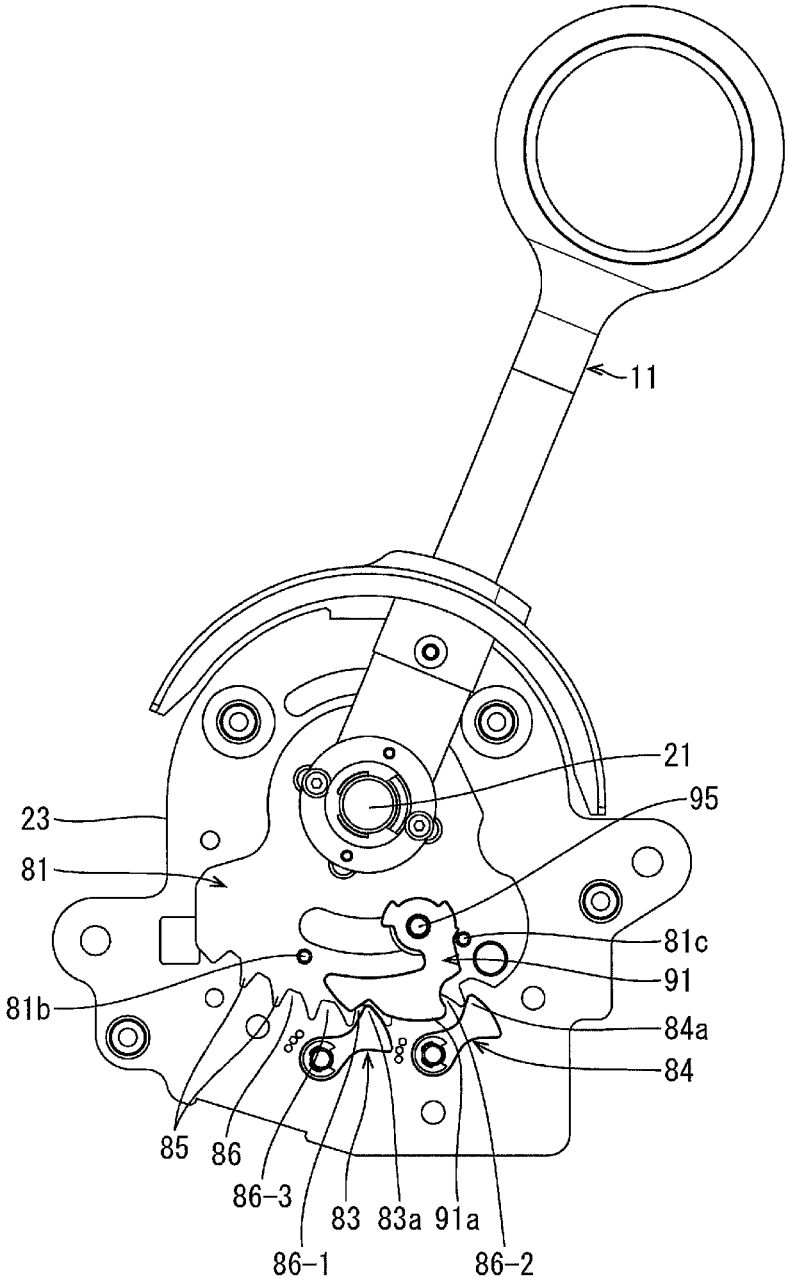
FIG. 7 is a diagram for describing a standby state of the ratchet mechanism with the start lever in the handle module in the home position.
Figure 8:
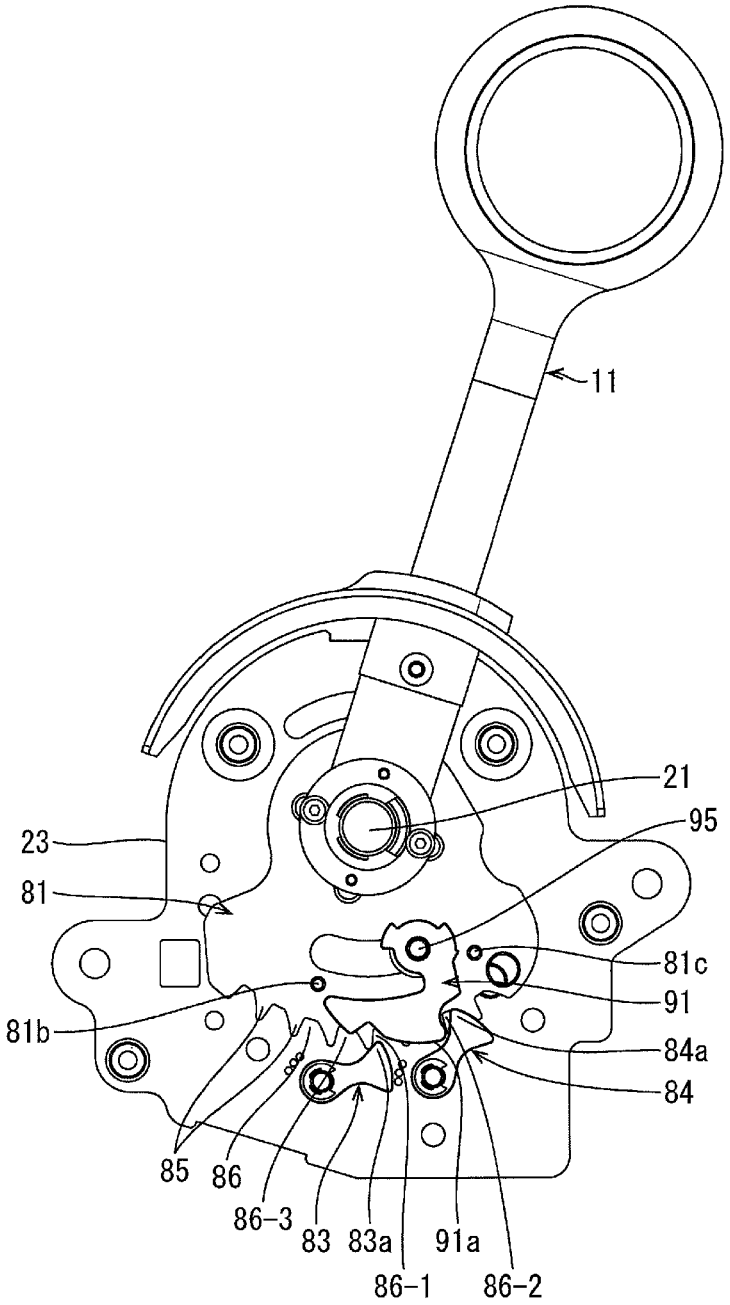
FIG. 8 is a diagram for describing a state in which the ratchet mechanism has rotated one step with the start lever having been pulled down one level from the home position.
Figure 9:
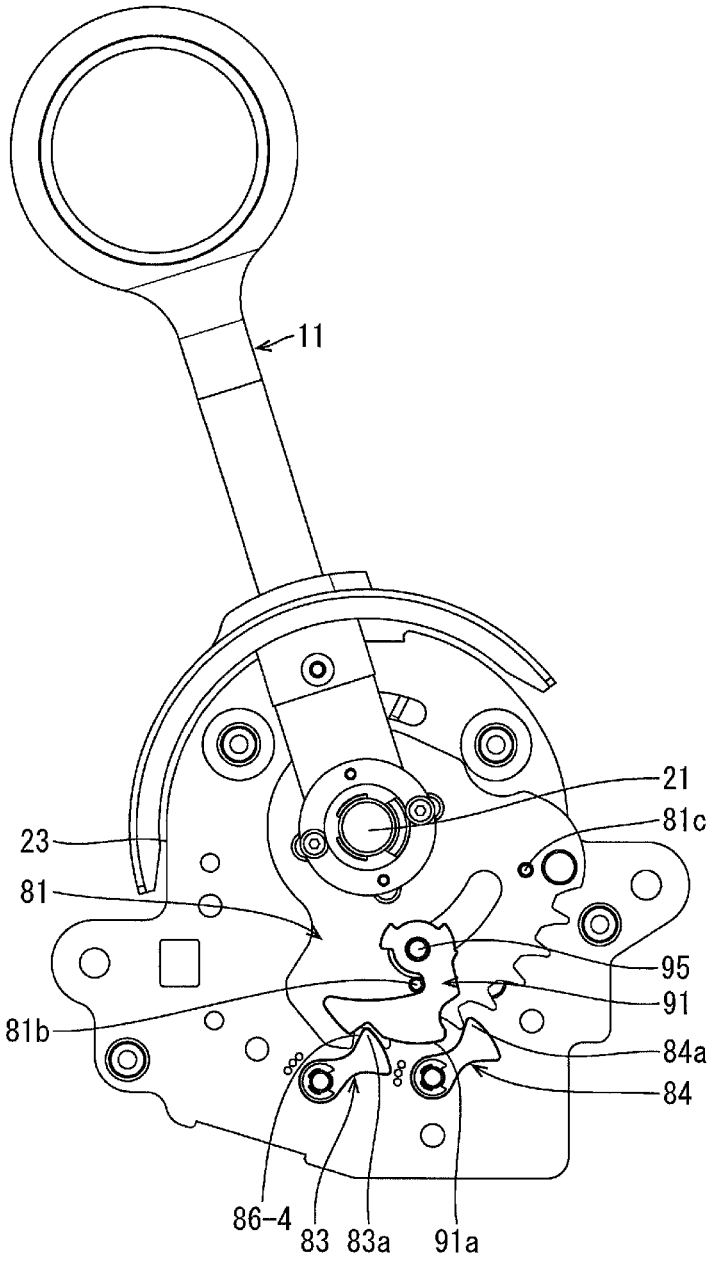
FIG. 9 is a diagram for describing a state in which the ratchet mechanism has rotated to one step before the final step with the start lever having been pulled down to one level before the end position.
Figure 10:
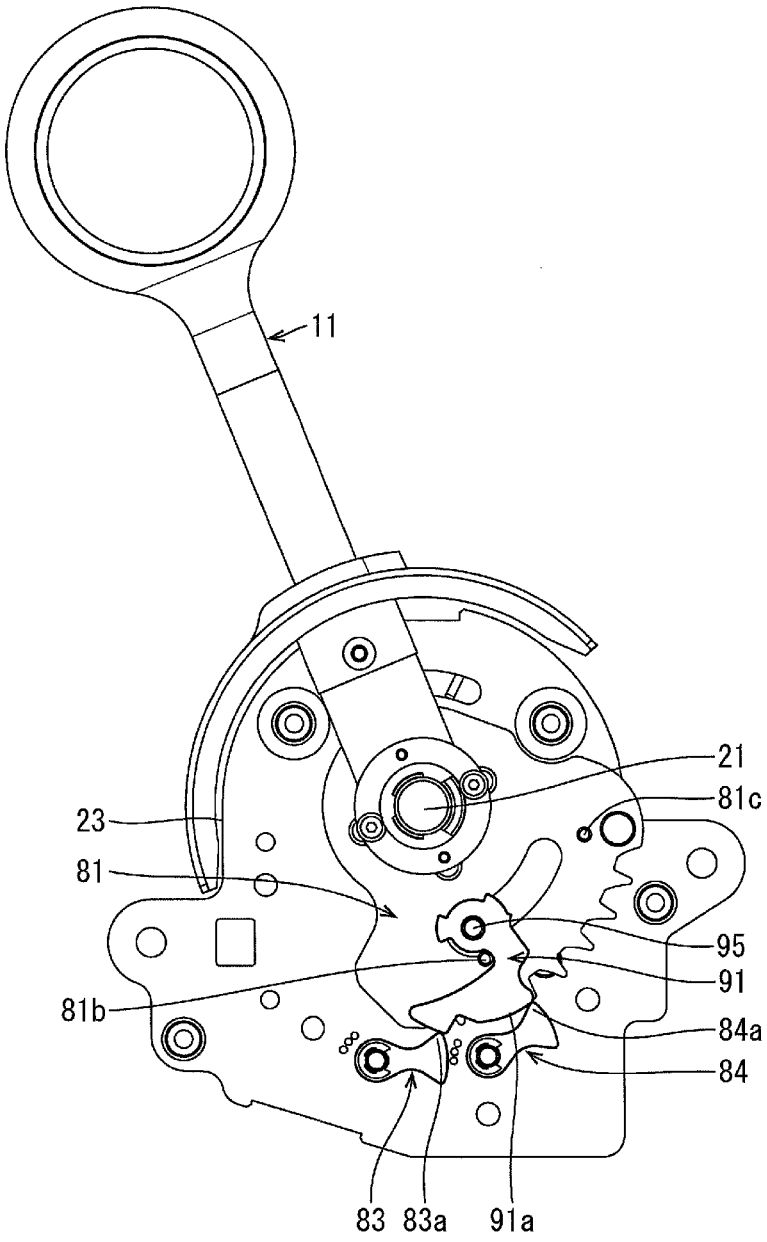
FIG. 10 is a diagram for describing a reset state of the ratchet mechanism where the start lever has been pulled down to the end position.

Next, description is given using FIG. 7 to FIG. 10 regarding operations of the ratchet mechanism 80. FIG. 7 is a diagram for describing a standby state of the ratchet mechanism 80 with the start lever 11 in the home position HP. FIG. 8 is a diagram for describing a state in which the ratchet mechanism 80 has rotated one step with the start lever 11 having been pulled down one level from the home position HP. FIG. 9 is a diagram for describing a state in which the ratchet mechanism 80 has rotated to one step before the final step with the start lever 11 having been pulled down to one level before the end position EP. FIG. 10 is a diagram for describing a reset state of the ratchet mechanism 80 where the start lever 11 has been pulled down to the end position EP.

As shown in FIG. 7, in a state in which the ratchet mechanism 80 is on standby with the start lever 11 in the home position HP, the engaging portion 83*a* of the ratchet pawl 83 is meshed with a tooth depression portion 86-1 of the rotation plate 81. On the other hand, the engaging portion 84*a* of the ratchet pawl 84 is not meshed with any of the tooth depression portions 86. Furthermore, the reset piece 91 of the reset mechanism 90 is in a reset position not contacting the ratchet pawls 83 and 84.

When the start lever 11 is pulled down one level from the state shown in FIG. 7, the meshing between the engaging portion 83*a* of the ratchet pawl 83 and the tooth depression portion 86-1 is released as shown in FIG. 8, and now the engaging portion 84*a* of the ratchet pawl 84 meshes with a tooth depression portion 86-2. The movement distance of the rotation plate 81 when the start lever 11 has been pulled down one level is ½ the pitch of the teeth 85.

Although not shown in the diagram, it should be noted that when the start lever 11 is pulled down a further one level from the state shown in FIG. 8, the meshing between the engaging portion 84*a* of the ratchet pawl 84 and the tooth depression portion 86-2 is released, and now the engaging portion 83*a* of the ratchet pawl 83 meshes with a tooth depression portion 86-3 (see FIG. 7 and FIG. 8).

In this way, with the configuration of the ratchet mechanism 80, each time the rotation plate 81 moves a distance ½ the pitch of the teeth 85, it is possible for the start lever 11 to be pulled down one level.

And when the start lever 11 is pulled down to one step before the final step of the ratchet mechanism 80 as shown in FIG. 9, the engaging portion 83*a* of the ratchet pawl 83 meshes with a tooth depression portion 86-4 of the final level of the rotation plate 81. On the other hand, the engaging portion 84*a* of the ratchet pawl 84 does not meshed with any of the tooth depression portions 86. Furthermore, in this state, the reset piece 91 contacts a protrusion 81*b* formed on the rotation plate 81.

When the start lever 11 is pulled down a further one level from the state shown in FIG. 9 and reaches the end position EP, the reset piece 91 pushes the protrusion 81*b* formed on the rotation plate 81 and rotates counterclockwise centered on the shaft 95, and moves to the reset position as shown in FIG. 10. Due to this, a releasing portion 91*a* pushes down on the ratchet pawls 83 and 84 and the meshing between the ratchet pawls 83 and 84 and the rotation plate 81 is released. When the constraint of the ratchet mechanism 80 is released, the start lever 11 automatically returns to the home position HP due to the force of the biasing spring.

Configuration of Ratchet Mechanism 90

Figure 11:
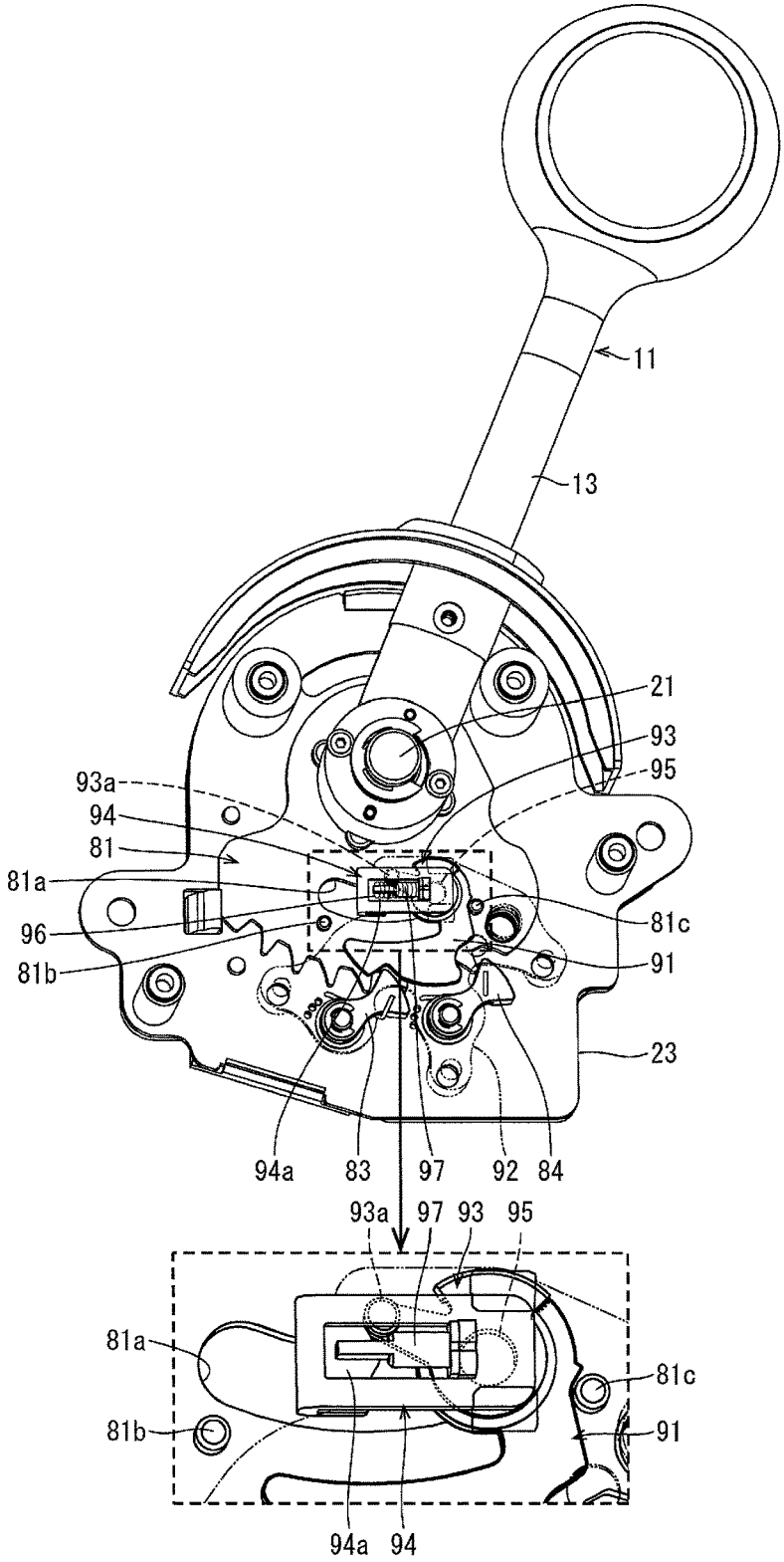
FIG. 11 is a perspective view of principal components of the handle module for describing configurations of the reset piece biasing disk and the reset piece biasing disk guide of the reset mechanism.
Figure 12:
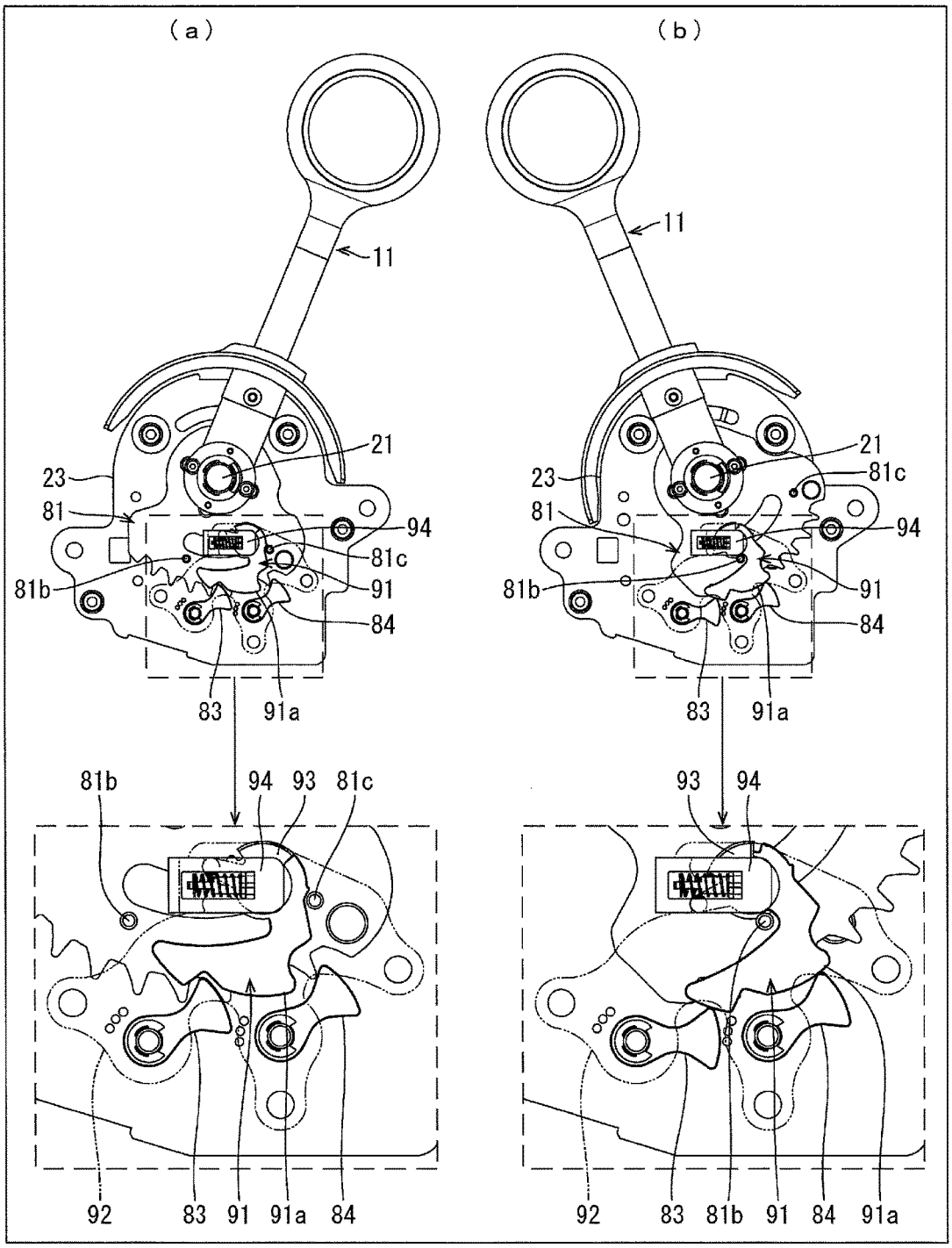
FIG. 12 is a diagram for describing operations of the reset mechanism that resets the ratchet mechanism.
Figure 13:
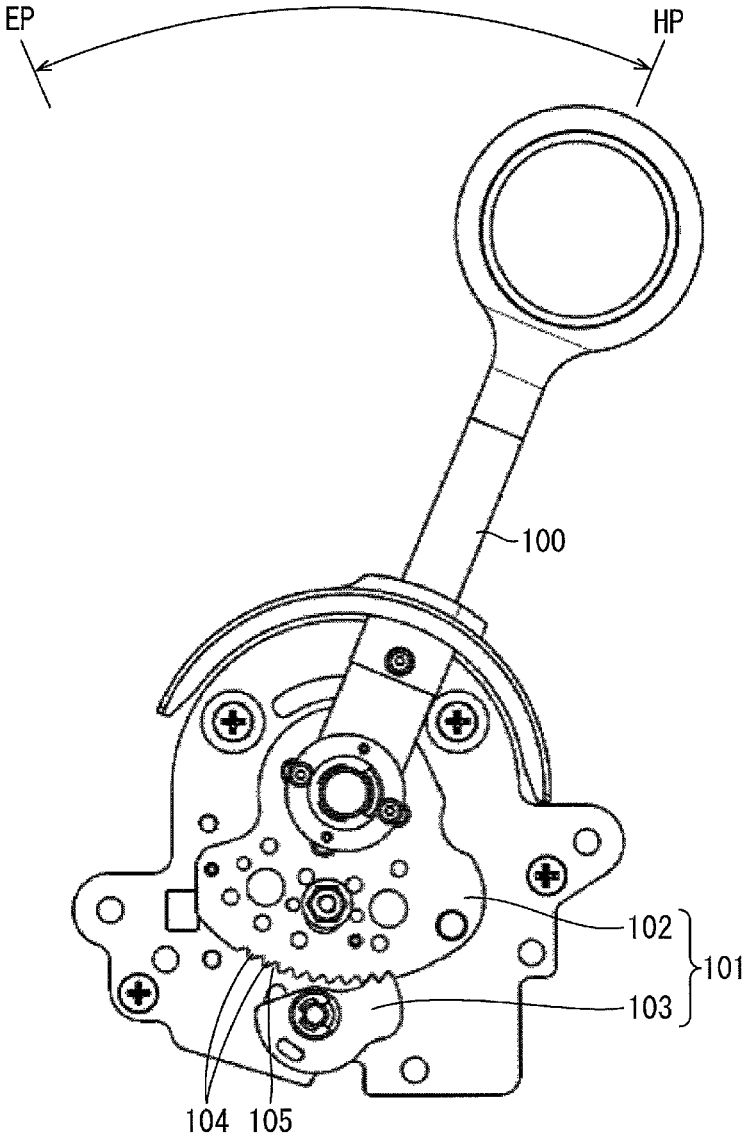
FIG. 13 is an exploded perspective view of principal components of a handle module for describing a configuration of a ratchet mechanism in a conventionally configured lever unit.

Next, description is given using the aforementioned FIG. 5 and FIG. 6 and FIG. 11 and FIG. 12 regarding the configuration of the reset mechanism 90. FIG. 11 is a perspective view of principal components of the handle module 20 for describing configurations of the reset piece biasing disk 93 and the reset piece biasing disk guide 94 of the reset mechanism 90. FIG. 12 is a diagram for describing operations of the reset mechanism, with (a) showing a state in which the reset piece 91 is in a set position and (b) showing a state in which the reset piece 91 is in a reset position.

As shown in FIG. 5 and FIG. 6, the reset mechanism 90 is provided with a reset piece 91, a ratchet mechanism cover 92, a reset piece biasing disk 93, and a reset piece biasing disk guide 94.

The reset piece 91 is an L-shaped plate and, in a state in which it lies along the inner side face of the rotation plate 81, its upper end portion on the vertical line portion of the L-shape is axially supported on a shaft 95. When force is applied to the reset piece 91, the reset piece 91 is rotatably supported with the shaft 95 as its fulcrum. Accompanying movement of the start lever 11, the reset piece 91 collides against the protrusions 81*b* and 81*c* formed on the rotation plate 81, and alternately switches from the set position to the reset position by rotating on the shaft 95 as a fulcrum upon further movement of the start lever in that state.

In the reset position, a bottom surface of the horizontal line portion of the L-shape in the reset piece 91 functions as the releasing portion 91*a* that releases the meshing of the ratchet pawls 83 and 84 and the rotation plate 81 when the ratchet pawls 83 and 84 are pushed down. It should be noted that the releasing portion 91*a* is formed in a shape that does not interfere with the ratchet pawls 83 and 84 in the set position.

The shaft 95 on which the reset piece 91 is axially supported is provided protruding from an inner side of the frame 23 to an inner side of the rotation plate 81 via an elongated hole 81*a* formed in the rotation plate 81. The aforementioned elongated hole 81*a* has a length and a shape that does not impede the rotation of the rotation plate 81 in movement of the start lever 11 from the home position HP to the end position EP.

The reset piece biasing disk 93 is provided on the same shaft as the reset piece 91 and moves integrally with the reset piece 91. The reset piece biasing disk 93 engages with the reset piece biasing disk guide 94 and applies a biasing force to the reset piece 91 to the set position or the reset position.

As shown in FIG. 11, the reset piece biasing disk guide 94 is provided with a mound shaped boss guiding portion 94*a* that provides a protrusion facing to the shaft 95 of the reset piece 91 (see enlargement in FIG. 11, spring 96 is omitted in the enlargement). A boss 93*a* of the reset piece biasing disk 93 that rotates together with the reset piece 91 guided and retained to above (set position) or below (reset position) the boss guiding portion 94*a* along this boss guiding portion 94*a*.

As shown in (a) of FIG. 12, by holding the boss 93*a* on top of the boss guiding portion 94*a*, the reset piece 91 is held in the set position. In a state where the reset piece 91 is in the set position, the releasing portion 91*a* does not contact the ratchet pawls 83 and 84. On the other hand, as shown in (b) of FIG. 12, by holding the boss 93*a* below the boss guiding portion 94*a*, the reset piece 91 is held in the reset position. In a state where the reset piece 91 is in the reset position, the releasing portion 91*a* pushes down the ratchet pawls 83 and 84. Due to this, the meshing between the ratchet pawls 83 and 84 and the rotation plate 81 is released.

As shown in FIG. 11, the aforementioned reset piece biasing disk guide 94 is attached to the ratchet mechanism cover 92, which is arranged so as to cover the ratchet mechanism 80. The reset piece biasing disk guide 94 is configured so as to readily slide along the direction in which the protrusion of the mound shaped boss guiding portion 94*a* is formed. And the reset piece biasing disk guide 94 is constantly under a biasing force in the direction in which the protrusion of the boss guiding portion 94*a* is formed due to the spring 96 and a spring guide shaft 97 arranged therein. In this way, the reset piece biasing disk guide 94 holds the stature of the reset piece biasing disk 93 by engaging with the boss 93*a* on the side of the reset piece biasing disk 93, and the reset piece biasing disk guide 94 also assists override operations by moving to resist the biasing force of the spring 96 when the boss 93*a* overrides the boss guiding portion 94*a*.

As described above, the lever unit 10 according to the present embodiment is configured so that the ratchet mechanism 80 opposes the rotation plate 81, which rotates integrally with the start lever 11, and is provided with the two ratchet pawls 83 and 84, and these two ratchet pawls 83 and 84 alternately mesh with the tooth depression portions 86 with timings shifted from each other in the interval in which the rotation plate 81 moves one pitch portion of the teeth 85. In other words, it is configured so that both of the two ratchet pawls 83 and 84 mesh with one of the tooth depression portions 86 with shifted timings each time the rotation plate 81 moves one pitch portion of the teeth 85.

In this way, in movement of the rotation plate 81 of one pitch portion of the teeth 85, a sensation can be obtained that has two times the amount of clicking, which is the meshing of the two ratchet pawls 83 and 84. Accordingly, compared to a conventional configuration in which only one ratchet pawl is provided on the rotation plate, the pitch of the teeth 85 can be doubled in a case where there is the same number of steps (number of levels).

And by being able to enlarge (coarsen) the pitch of the teeth 85 by two times, it becomes possible to deepen the depth of the tooth depression portions 86, and various operational sensations can be provided by altering the depth of the meshing and the shape of the teeth 85 and the like. Furthermore, by being able to enlarge (coarsen) the pitch of the teeth 85, the strength of the meshing portions can be increased and it becomes easy to maintain a required strength.

It should be noted that in the present embodiment, an example configuration was illustrated in which the two ratchet pawls 83 and 84 are provided for the single rotation plate 81, but configurations are possible in which three or more ratchet pawls are provided. In a configuration provided with three ratchet pawls, the pitch of the teeth of the rotation plate can be three times.

In a configuration provided with three ratchet pawls, one of the three is set as a standard, and the interval between this standard ratchet pawl and the engaging portions is set respectively to (N+⅓) times and (N+⅔) times the pitch of the teeth of the rotation plate. N is zero and natural numbers. In this way, the three ratchet pawls do not mesh with the tooth depression portions at the same time, but rather mesh alternately each time the rotation plate rotates by a distance that is ⅓ of the pitch of the teeth.

In short, it is sufficient that the multiple ratchet pawls are set in an array along the outer edge of the rotation plate so that each time the rotation plate moves a single pitch portion of the teeth, the engaging portions of all of the ratchet pawls mesh alternately with one of the tooth depression portions.

SUMMARY

A lever unit according to the present invention is provided with a lever rotatably provided on a shaft, a ratchet mechanism that restricts a movement direction of the lever to one direction, and a reset mechanism that releases the restriction on the movement direction by the ratchet mechanism, wherein the ratchet mechanism is provided with a rotational body that rotates integrally with the lever and on which multiple teeth are formed on an outer edge thereof, and multiple latch pieces having engaging portions that mesh with tooth depression portions between the teeth of the rotational body, and the multiple latch pieces are set in an array along an outer edge of the rotational body so that each time the rotational body moves a single pitch portion of the teeth, the engaging portions of all of the latch pieces mesh alternately with one of the tooth depression portions.

With the above-described configuration, the multiple latch pieces are set in an array along the outer edge of the rotational body so that each time the rotational body moves a single pitch portion of the teeth, the engaging portions of all of the latch pieces mesh alternately with one of the tooth depression portions. Accordingly, in the movement of a single pitch portion of the rotational body, it is possible to obtain a clicking sensation for the number of latch pieces provided. That is, in the movement of a single pitch portion of the rotational body, it is possible to ensure a number of steps that corresponds to the number of latch pieces provided.

In this way, for example, with a configuration provided with two latch pieces, compared to a conventional configuration in which only one latch piece is provided, the pitch of the teeth can be doubled in a case where there is the same number of steps. In a configuration provided with three latch pieces, this can be tripled.

And by being able to enlarge (coarsen) the pitch of the teeth by two or three times, it becomes possible to deepen the depth of the tooth depression portions, and various operational sensations can be provided by altering the depth of the meshing and the shape of the teeth and the like. Furthermore, by being able to enlarge (coarsen) the pitch of the teeth two or three times, it becomes easy to maintain the required strength in the meshing portions.

A lever unit according to the present invention can further be configured such that the release mechanism is provided with a releasing piece that contacts and presses the multiple latch pieces respectively and causes the engaging portion to disengage from the outer edge of the rotational body.

With the above-described configuration, it is possible to disengage the engaging portions of multiple latch pieces as a group together with a single releasing piece. Accordingly, compared to a configuration in which releasing pieces are provided corresponding to multiple latch pieces, the reset mechanism can be simplified.

The present invention is not limited to any of the above-described embodiments and various modifications are possible within the scope of the claims, and embodiments obtainable by combining as appropriate technical means disclosed in the different embodiments respectively are included in the technical scope of the present invention.

INDUSTRIAL APPLICABILITY

The present invention can be used in gaming machines or the like provided with a lever that is installed so as to rotate readily in two directions on a shaft such as in a slot machine.

INDEX TO THE REFERENCE NUMERALS

1 . . . slot machine, 10 . . . lever unit, 11 . . . start lever (lever), 20 . . . handle module, 21 . . . securing shaft, 23, 25 . . . frame, 27 . . . support member, 80 . . . ratchet mechanism, 81 . . . rotation plate (rotational body), 83 . . . ratchet pawl, 83, 84 . . . ratchet pawl (latch piece), 83*a*, 84*a* . . . engaging portion, 85 . . . tooth, 86 . . . tooth depression portion, 90 . . . reset mechanism, 91 . . . reset piece (releasing piece), 91*a* . . . releasing portion, 95 . . . shaft.

The invention claimed is:

1. A lever unit comprising:

a lever rotatably provided on a shaft, a ratchet restricting a movement direction of the lever to one direction, and a reset piece releasing the restriction on the movement direction by the ratchet, wherein the ratchet comprises:

a rotational body that rotates integrally with the lever and on which multiple teeth are formed on an outer edge thereof, and multiple latch pieces having engaging portions that mesh with tooth depression portions between the teeth of the rotational body, and the multiple latch pieces are set in an array along the outer edge of the rotational body so that each time the rotational body moves a single pitch of the teeth, only one of the engaging portions of all of the latch pieces meshes with one of the tooth depression portions.

2. The lever unit according to claim 1, wherein the reset piece contacts and presses the multiple latch pieces respectively and causes the engaging portion to disengage from the outer edge of the rotational body.

3. The lever unit according to claim 1, further comprising a frame; and a support member fixed to the frame and supporting the lever to be rotatable about the shaft with respect to the frame.

4. The lever unit according to claim 3, wherein the latch pieces are rotatably supported by the frame and biased in a direction that the engaging portions of the latch pieces mesh into the tooth depression portions of the rotational body.

5. The lever unit according to claim 1, wherein the multiple latch pieces comprise two latch pieces, and a distance between the engagement portions of the two latch pieces is set to (N+½) times a pitch of the teeth, where the N is zero and a natural number.

6. The lever unit according to claim 1, wherein the multiple latch pieces comprise first to third latch pieces, and a distance between the engagement portion of the first latch piece and the engagement portion of the second latch piece is set to (N+⅓) times a pitch of the teeth and a distance between the engagement portion of the first latch piece and the engagement portion of the third latch piece is set to (M+⅔) times the pitch of the teeth, where N is zero or a natural number and M is zero or a natural number.

* * * * *